United States Patent [19]

Harris et al.

[11] 4,180,759

[45] Dec. 25, 1979

[54] THERMAL CAMERA TUBES

[75] Inventors: Jeffrey J. Harris, Colchester; Brian W. Rampling, Maldon, both of England

[73] Assignee: English Electric Valve Company Limited, Chelmsford, England

[21] Appl. No.: 844,179

[22] Filed: Oct. 21, 1977

[30] Foreign Application Priority Data

Aug. 20, 1977 [GB] United Kingdom ..... 35045/77

[51] Int. Cl.[2] ..... H01J 29/45

[52] U.S. Cl. ..... 313/388; 313/101; 313/367; 313/374

[58] Field of Search ..... 313/388, 101, 367, 376; 250/213 VT, 338

[56] References Cited

U.S. PATENT DOCUMENTS

| | | | |
|---|---|---|---|
| 3,821,092 | 6/1974 | Frobenius | 313/367 X |
| 3,879,631 | 4/1975 | Yu | 313/367 X |
| 3,883,769 | 5/1975 | Finnila | 313/367 |
| 3,902,095 | 8/1975 | Bierig et al. | 313/367 |
| 4,012,660 | 3/1977 | Losehand et al. | 313/367 X |
| 4,053,806 | 10/1977 | Turnbull et al. | 313/388 |

*Primary Examiner*—Robert Segal
*Assistant Examiner*—Darwin R. Hostetter
*Attorney, Agent, or Firm*—Diller, Ramik & Wight

[57] ABSTRACT

The invention provides a thermal camera tube having a reticulated pyroelectric target, that is to say a target having a plurality of separate pyroelectric elements arranged in rows and columns and separated by channels. Each of the separate elements has the shape of a cube the vertical sides of which are inclined so that, except for those in one outer column and one outer row, on two of its sides the top of each element overhangs the base of an adjacent element in the same row and the base on an adjacent element in the same column so that the overhanging surface of the element is exposed to radiation in the region of channels separating it from the aforementioned adjacent elements.

8 Claims, 3 Drawing Figures

THERMAL CAMERA TUBES

This invention relates to thermal camera tubes and in particular to thermal camera tubes, such as a thermal vidicon camera tube, having reticulated pyroelectric targets.

As is known, the undesirable lateral thermal diffusion of a heat pattern imaged on to a pyroelectric target of a vidicon camera tube can be reduced if the target is reticulated, that is to say divided into an array of small elements, spatially separated one from another and mounted on a supporting layer having a low thermal conductivity.

Figure 1:
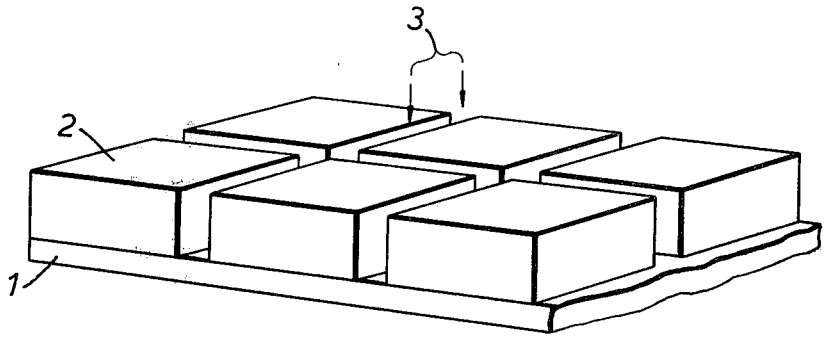
FIG. 1. PRIOR ART

Part of a typically known pyroelectric vidicon target is represented in FIG. 1 of the accompanying drawings.

Referring to FIG. 1, the target consists of a supporting layer 1 which is of low thermal conductivity, upon which is mounted rows and columns of cubical elements of pyroelectric material such as that referenced 2. Between the rows and columns of pyroelectric elements 2 are channels such as 3 which act to reduce lateral thermal conductivity.

However, the improvement in performance which is obtained utilising a pyroelectric target as represented in FIG. 1 is partially off-set by the reduction in responsivity which occurs because of the absence of active pyroelectric material within the channels 3 between the rows and columns of pyroelectric elements 2.

The present invention seeks to provide an improved thermal camera tube having a reticulated pyroelectric target in which the above difficulty is reduced.

According to this invention, a thermal camera tube is provided having a reticulated pyroelectric target and wherein one or more of the separate pyroelectric elements of said target overhangs on at least one side a channel separating it from an adjacent pyroelectric element whereby the overhanging surface of said element is exposed to radiation incident in the region of said channel.

Preferably every channel between the separate elements is overlapped by overhanging surfaces of said elements.

Preferably again every channel between the separate elements is overlapped completely by overhanging surfaces of said element.

Preferably the separate elements are arranged in rows and columns and each element has the shape of a cube the vertical sides of which are inclined so that, except for those in one outer column and one outer row, on two of its sides the top of each element overhangs the base of an adjacent element in the same row and the base of an adjacent element in the same column.

Preferably the ratio of the depth of each element to the width of each of the channels separating the rows and columns is four to one and the angle of inclination is 20° to the normal from the surface of a supporting layer carrying said elements.

Preferably said supporting layer is comprised of a polymer film.

Said polymer film may be electrically non conductive and have an electrical conductive signal plate applied thereto constituting said surface, but preferably said polymer film is itself electrically conductive with or without an electrical conductive signal plate applied thereto constituting said surface.

The separate pyroelectric elements are normally of the pyroelectric material TGS (triglycine sulphate) or one of its isomorphs.

The invention is illustrated in and further described with reference to FIGS. 2 and 3 of the accompanying drawings, which illustrate the reticulated pyroelectric target of a thermal vidicon camera tube in accordance with the present invention.

As will be seen, the reticulated pyroelectric target shown in FIG. 2 again consists of rows and columns of separate pyroelectric elements 4 mounting on a supporting layer 5 of material of low thermal conductivity. The rows and columns of separate elements 4 are separated by channels 6.

Figure 2:
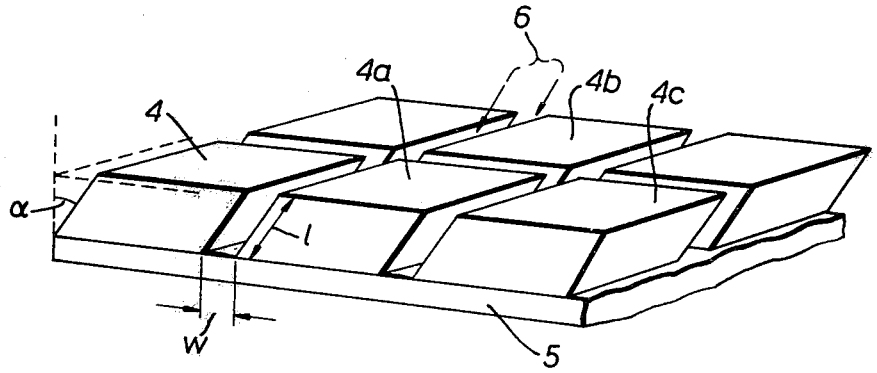

Unlike the elements 2 in FIG. 1, the elements 4 in FIG. 2 are not cubical. In FIG. 2 each element 4 has the shape of a cube the vertical sides of which are inclined so that the top of each element 4, except for the elements in one outer column and one outer row, overhangs the base of an adjacent element in the same row and the base of an adjacent element in the same column. Thus for example the top of the element 4*a* overhangs the base of the element 4*b* in the same column and the base of the element 4*c* in the same row. The result of this is that radiation transmitted through the supporting layer 5 in a direction perpendicular to the surface of the supporting layer 5, in the region of the channels 6 falls upon the overhanging surfaces of the inclined sides of the elements 4, thus tending to restore the reduction in responsivity which would otherwise be experienced by virtue of there being no active pyroelectric material within the channels 6 themselves.

Figure 3:
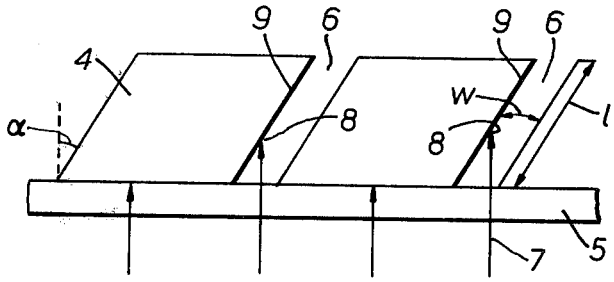

This effect is illustrated in FIG. 3 of the accompanying drawings which shows radiation transmitted through the supporting layer 5 in the direction of the arrows 7 being absorbed at 8 by the overhanging surfaces of the inclined sides 9 of the pyroelectric elements 4.

In the particular example illustrated by FIG. 2 the supporting layer 5 is a polymer film which is electrically conductive, as known per se. The pyroelectric material of the elements 4 is TGS (triglycine sulphate), which elements 4 have the same depth $\alpha$ equal to $20\mu$ and the channels 6 are of the same width w equal to $5\mu$. The angle of inclination $\alpha$ of the sides of each element 4 is 20°.

The structure is produced by masking the top surface of the TGS target with an array of metal or photoresist squares, to define the required positions of the elements 4, and then ion beam milling using a large area ion beam inclined at an angle of 45° to the directions of the channels 6 between the elements 4, and inclined at an angle of 20° to the normal to the surface in order to produce the inclined sides of the elements 4. The masking material may then be removed from the top of the elements 4.

We claim:

1. A pyroelectric target plate for a thermal camera tube comprising, in combination:

a supporting layer of low thermal conductivity; and an array of pyroelectric target elements on one surface of said supporting layer, said elements being disposed in regularly spaced relation in a plurality of columns and a plurality of rows thereof whereby to define channels between the elements, at least a majority of said elements completely overhanging channels adjacent thereto, thereby tending to restore the reduction in responsivity which would otherwise be experienced by virtue of there being no pyroelectric material within the channels themselves.

2. A target plate as defined in claim 1 wherein said supporting layer comprises a polymer film which is electrically non-conductive and an electrically conductive signal plate on said film which constitutes said one surface of the supporting layer.

3. A thermal camera tube having a reticulated pyroelectric target and wherein separate pyroelectric elements of said target overhang channels separating it from adjacent pyroelectric elements whereby the overhanging surfaces of said element are exposed to radiation incident in the region of said channels, every channel between the separate elements being overlapped completely by overhanging surfaces of said element.

4. A thermal camera tube having a reticulated pyroelectric target and wherein one or more of the separate pyroelectric elements of said target overhang channels separating it from adjacent pyroelectric elements whereby the overhanging surfaces of said element are exposed to radiation incident in the region of said channels, the separate elements being arranged in rows and columns and each element having the shape of a cube the vertical sides of which are inclined so that, except for those in one outer column and one outer row, on two of its sides the top of each element overhangs the base of an adjacent element in the same row and the base of an adjacent element in the same column.

5. A tube as claimed in claim 4 and wherein the ratio of the depth of each element to the width of each of the channels separating the rows and columns is four to one and the angle of inclination is 20° to the normal from the surface of a supporting layer carrying said elements.

6. A tube as claimed in claim 5 and wherein said supporting layer is comprised of a polymer film.

7. A tube as claimed in claim 6 and wherein said polymer film is electrically non-conductive and is an electrical conductive signal plate applied thereto constituting said surface.

8. A tube as claimed in claim 5 wherein said layer comprises a polymer film which is itself electrically conductive and constitutes said surface of the supporting layer.

* * * * *